US005743184A

United States Patent [19]

Skudrzyk

[11] Patent Number: 5,743,184

[45] Date of Patent: Apr. 28, 1998

[54] GEARLESS PRINTING PRESS

[75] Inventor: Joseph Skudrzyk, St. Louis, Mo.

[73] Assignee: Joe Irace, Osprey, Fla.

[21] Appl. No.: 863,167

[22] Filed: May 27, 1997

[51] Int. Cl.[6] ..... B41F 5/16

[52] U.S. Cl. ..... 101/181; 101/248; 226/28

[58] Field of Search ..... 101/181, 183, 101/219, 211, 225, 228, 248, 485; 226/28, 29, 27, 45

[56] References Cited

U.S. PATENT DOCUMENTS

| | | | |
|---|---|---|---|
| 3,934,505 | 1/1976 | Kushner | 101/181 |
| 3,946,537 | 3/1976 | Hair et al. . | |
| 4,264,957 | 4/1981 | Pautzke | 226/28 |
| 4,299,223 | 11/1981 | Cronkite . | |
| 4,318,176 | 3/1982 | Stratton et al. | 226/28 |
| 4,450,766 | 5/1984 | Inomata et al. . | |
| 4,527,788 | 7/1985 | Masuda | 101/248 |
| 4,541,335 | 9/1985 | Tokuno et al. | 101/219 |
| 4,605,459 | 8/1986 | Voltmer et al. . | |
| 4,647,333 | 3/1987 | Voltmer et al. . | |
| 4,839,814 | 6/1989 | Stetdel | 226/29 |
| 4,898,094 | 2/1990 | Doumoto et al. | 101/248 |
| 5,043,904 | 8/1991 | Sikes et al. | 101/248 |
| 5,117,753 | 6/1992 | Mamberer . | |
| 5,127,324 | 7/1992 | Palmatier et al. | 101/248 |
| 5,129,568 | 7/1992 | Fokos et al. | 226/27 |
| 5,263,413 | 11/1993 | Ikeguchi . | |
| 5,312,033 | 5/1994 | Walton et al. | 101/248 |
| 5,377,585 | 1/1995 | Kipphan et al. . | |
| 5,386,772 | 2/1995 | Tolle et al. | 226/45 |
| 5,398,603 | 3/1995 | Hartmann et al. . | |
| 5,455,764 | 10/1995 | Melhofer | 226/27 |

*Primary Examiner*—Eugene H. Eickholt
*Attorney, Agent, or Firm*—Paul M. Denk

[57] ABSTRACT

A printing press is provided which may be adapted to print in multiple colors on paper or film. The press can then laminate film-to-film, laminate film-to-paper, or apply a PVA adhesive or cold seal adhesive to the substrate in line. The press is provided with a CPU and a plurality of motors each of which drives an individual roller, i.e. a printing station roller, a nip, or the rewind roller, and a plurality of sensors which monitor the speed of the laminate and substrate, the tension of the laminate in substrate in various places. In response to the signals received from the sensors, the CPU individually controls the motors to maintain the printing stations in registry with each other.

16 Claims, 3 Drawing Sheets

GEARLESS PRINTING PRESS

BACKGROUND OF THE INVENTION

This invention relates to printing presses, and in particular, to a gearless printing press which can print on many different types of substrates, which can print in multiple colors, and which can maintain alignment of various print stations to avoid blurring of multi-colored images.

Two types of printing presses are commonly used in flexographic printing: stack presses and central impression presses. Both the stack presses and central impression presses have unwind rollers, rewind rollers, and printing stations positioned between the unwind and rewind rollers. The rollers and printing stations typically are driven by electric motors through a series of gears. That is, the printing stations and rollers are not directly driven by the motors, rather gears are used to couple the motor output to axles of the rewind and unwind rollers and axles of the rollers at the print stations. To maintain the various printing stations in registration, the gears are generally controlled with the use of hydraulic units. The use of hydraulics to align the printing stations or keep them in registry with each other is complex and difficult.

Stack type printing presses print at individual or independent printing stations, which as noted, are gear driven. Because of the use of individual printing stations, stack type presses have difficulty in doing process printing where combinations of colors are superimposed over each other to obtain other colors, various shades of a color, and feather variation between colors. The inability to control the registry of the various printing stations obviously affects the resulting image that is printed by the press. Stack presses have a float area between the unwind roller and the printing station. Substrates such as packaging films of polyester, polypropylene, and polyethylene stretch in the float area, and the web is almost impossible to control in the float area. These difficulties with stack type presses severely limit the types of printing jobs for which they may be used and limits the use of the press to substrates, such as paper, which will not stretch substantially. Therefore, although stack type printing presses are inexpensive to purchase and operate, they are limited as to the types of substrates which can be used and the printing results that can be obtained.

Many of the problems inherent with stack type printing presses have been overcome in the central impression type printing press. In a central impression press, the web (substrate) is brought into contact with a rolling drum. The web moves at the same rate as the drum rotates, and hence, any one portion of the web stays in contact with only one portion of the drum while the web is in contact with the drum. The web then passes under and against gear driven impression cylinders which print images on the web. The gears which drive the impression cylinders are driven by motors. In central impression presses, the web is more easily controlled, and these presses can thus be used for process printing and with a wider variety of substrates than stack type presses. However, central impression presses are difficult to maintain. The gears must be constantly monitored, maintained, and replaced when necessary. If not properly maintained, the press will not produce acceptable results from process printing jobs. Central impression presses thus require skilled and experienced workers to operate.

Although stack presses and central impression presses have performed well for those who can control them, there is a need to overcome their basic draw backs and to provide a printing press which can be used with multiple substrates and for process printing, yet which is inexpensive to maintain.

BRIEF SUMMARY OF THE INVENTION

One object of the present invention is to provide a printing press which may be used with a wide variety of substrates and for a wide variety of printing jobs, including process printing.

Another object is to provide such a printing press which utilizes printing rollers which are individually controlled to maintain them in registry with each other.

Another object is to provide such a printing press which is gearless.

Another object is to provide such a printing press which can apply coatings or laminations to the printed substrate.

These and other objects will become apparent to those skilled in the art in light of the following disclosure and accompanying figures.

Briefly stated, a printing press is provided which is capable of printing multi-color images on a paper or film substrate and then either apply a PVA coating to the substrate or laminate the substrate in a continuous process. The printing press includes a main unwind roller about which the substrate to be printed is wound and a main nip through which the substrate passes. The nip is directly driven by a main nip motor and drives the main unwind roller by pulling the substrate. A substrate printing area comprises a plurality of print stations. Each print station has an impression cylinder, a printing cylinder in rolling contact with the impression cylinder to be driven thereby, and a motor which directly drives the impression cylinder. The printing area can be provided with up to five printing stations to enable the printer to print in any color desired. The printing press includes a central processing unit (CPU) which individually controls the various print station motors to maintain the print stations in registry with each other. This will substantially prevent the printing of blurred multi-colored images. A speed monitor is provided between the main nip and a first of the plurality of printing stations. The CPU controls the print station motors in response to the signal from the speed monitor. A monitor is also provided to monitor the rotational position of the cylinders of the print stations. Prior to beginning a print run, the CPU rotates the print station cylinders in response to the rotational position monitor to ensure that the print stations begin a printing run in registry with each other.

The rotational position monitor includes a tab on one of the cylinders at each print station and a sensor for locating the rotational position of the tab. The tabs are in the same location relative to the image at the various print stations so that the CPU will know the location of the image at each print station.

A first float area is located between the main unwind roller and the main nips. The printing press includes a first controller for automatically maintaining the tension of the substrate in the first float area. The first tension controller includes a tension transducer in contact with the substrate to measure the tension of the substrate, a brake in operative contact with the main unwind roller, and a brake controller. The brake controller receives a signal from the tension transducer and controls the brake in response to the tension transducer signal to maintain the tension at a desired level.

The printed substrate is carried from the print area to a rewind nip and then to a rewind roller. Individual motors are provided to drive the rewind nip and the rewind roller. A second tension controller is provided to maintain the tension of the substrate in a second float area between the printing area and the rewind nips. The second tension controller includes a second tension transducer in contact with the web in the second float area. The central processing unit controls the speed of the rewind nip roller in response to the signal from the second tension transducer to maintain the tension of the substrate in the second float area.

A third tension controller is provided to maintain the tension of the substrate in a third float area between the rewind nip and the rewind roller. The third tension controller includes a third tension transducer in contact with the substrate in the third float area to determine the tension of the web in the third float area. The third tension transducer generates a signal indicative of the tension of the substrate in the third float area and the central processing unit controls the speed of the rewind motor in response to the signal from the third tension transducer to maintain the tension of the substrate in the third float area at a desired level.

A second printing area is also provided where a cold seal the substrate or a PVA coating can be applied to the substrate prior to winding the printed substrate on the rewind roller. This cold seal and PVA coating can be applied to both paper and film substrates.

A lamination unwind roller is also provided about which a lamination web is wound so that the substrate may be laminated. If the substrate is a paper substrate, the lamination web is brought through the second printing area where an adhesive is applied to the lamination web. If the substrate is a film substrate, then the lamination is carried through a corona treater. In either event, the lamination is pulled to the rewind nips where the lamination is applied and adhered to the substrate.

The printing press includes a fourth tension controller to maintain the tension in a fourth float area between the lamination unwind roller and the rewind nip at a desired level. The fourth tension controller includes a fourth tension transducer in contact with the lamination web to measure the tension of the lamination web in the fourth float area, a second brake in operative contact with the lamination unwind roller, and a second brake controller. The second brake controller receives a signal from the fourth tension transducer and controls the second brake in response to the signal from the fourth tension transducer to maintain the tension of the lamination web at a desired level in the fourth float area.

The printing press includes sensors which monitor the size of the main and lamination unwind rollers and the rewind roller. The CPU controls all the motors of the printing press in response to the signal received from these sensors.

A web guide may be provided in the first float area.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 1:
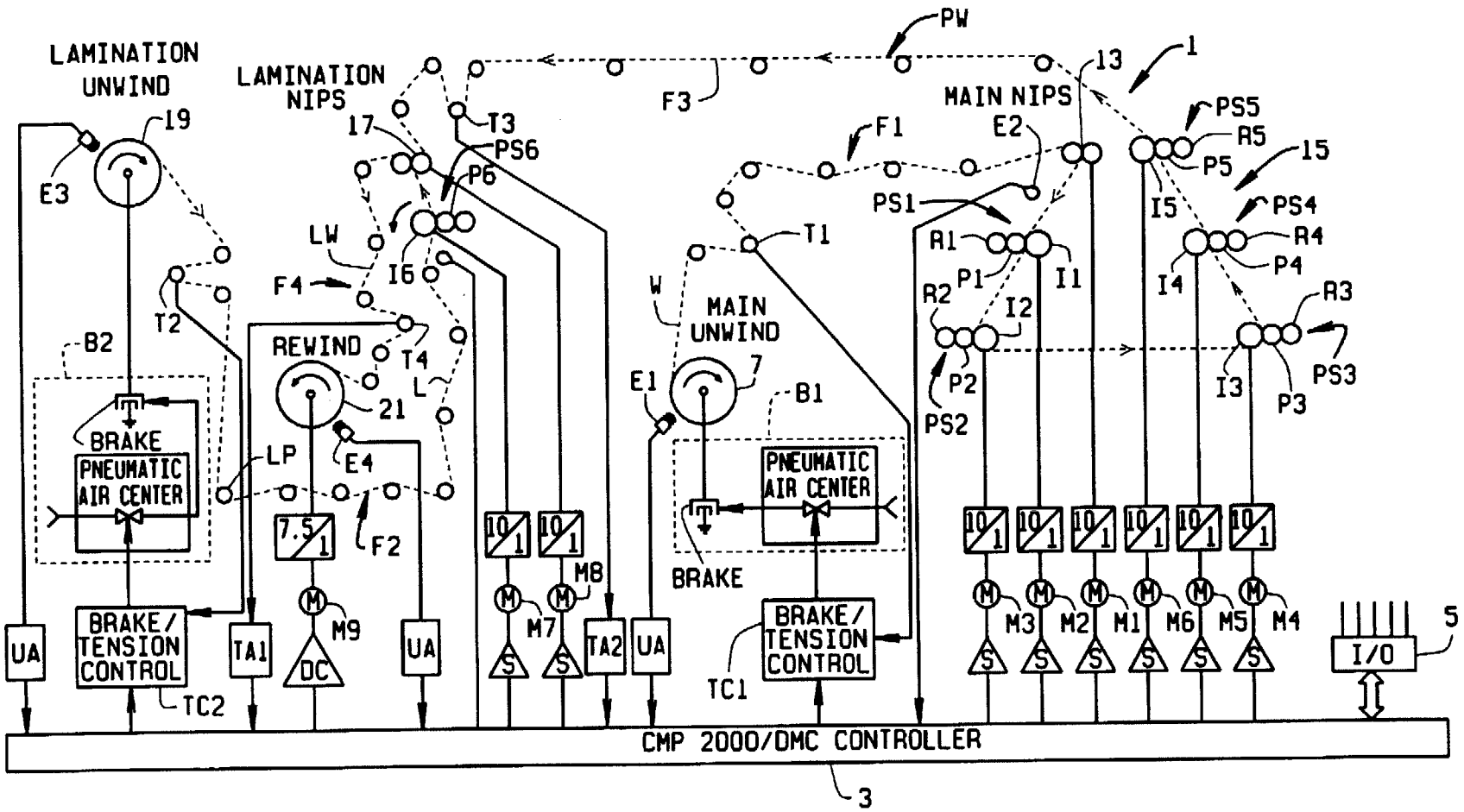
FIG. 1 is a schematic of a printing press of the present invention configured for process printing on a paper substrate and then applying a film lamination to the printed substrate.

A printing press 1 of the present invention is shown schematically in FIG. 1. The press 1 has a controller 3, which, as will be described, controls the press 1. The controller is preferably a CMP 2000/DMC controller available from Cleveland Machine Control. The press 1 also has an input/output interface 5 through which the various parameters of the press can be displayed or monitored and controlled or set. That is, the parameters, such as web tension or web speed can be selected and set via the interface input. The interface 5 can include a monitor and a keyboard or dials, for example.

The press 1 includes a main unwind roller 7 around which a substrate web W is rolled. The path PW of the substrate web W through the printing press is shown in dashed lines. The web W passes over a tension transducer T1 to a main nip 13 to the printing area 15 having a plurality of printing stations PS1–PS5. The printing stations PS1–PS5 each include an impression cylinder I1–I5, a printing cylinder P1–P5, and print rollers R1–R5. The main nip 13 is driven by a servo-motor M1 to pull the web W from the main unwind roller 7. The motor M1 is thus the primary driving force which pulls the web W from the unwind roller 7.

To maintain a desired tension of the web W in the float area F1 between the main unwind roller 7 and the nip 13, the web passes over the tension transducer T1. The transducer T1 generates a signal indicative of the tension of the web, which signal is received by a tension control TC1. The tension control TC1 controls a pneumatic brake B1. When the tension control TC1 activates the brake in response to the signal from the transducer T1, the brake applies a braking pressure to the main unwind roller 7 if the tension is too loose. This will of course increase the tension of the web W in the float area F1. If the tension is detected to be too high, the controller TC1 will cause the brake B1 to release its hold on the main unwind roller 7 to allow the roller 7 to rotate more freely, hence decreasing the tension of the web W in the float area F1.

An electric eye E1 is provided adjacent the main unwind roller 7. The eye E1 is preferably an ultrasonic sensor, such as is available from Cleveland Machine Control, and is used to determine the diameter of the web around the unwind roller 7. The eye E1 generates a signal indicative of the radius or diameter of the roller, and transmits this signal to the controller 3 which converts the information to determine the amount of substrate remaining on the roller. The controller 3 then uses this information to control the brake B1 and the motor M1.

The main nip 13 is directly driven by the servo-motor M1, which motor, as noted above, is the primary motor for pulling the substrate from the roller 7. The servo-motor M1 is a variable speed motor which, in turn, is controlled by the controller 3. The impression cylinders I1–I5 are similarly directly driven by servo-motors M2–M6. The motors M2–M6 directly drive the impression cylinders I1–I5. The impression cylinders I1–I5 then drive the printing cylinders P1–P5 via contact of the impression cylinders with the printing cylinders. Like motor M1, the servo-motors M2–M6 are variable speed motors which are controlled by the controller 3. The controller 3 independently controls the speed of each of the motors M2–M6 to maintain the various cylinders of the printing stations PS1–PS5 in register with each other. This will enable alignment of the images printed by each roller to be aligned with each other on the substrate to avoid blurred images or images which do not align to properly produce a final image.

To maintain the printing station cylinders in registry, the press 1 includes a photoelectric eye E2 positioned between the nip 13 and the first printing station PS1. The eye E2 generates signals indicative of the speed of the web W between the nip 13 and the roller R1 and transmits this signal to the controller 3. The controller uses the signal from the eye E2 to independently control the speed of the other motors M2–M6. As noted, there is a motor for each impression cylinder, and each motor is controlled independently of the other motors. Because there is a motor for each impression cylinder, rather than one motor for several gear driven rollers, energy is not lost in the transfer of motion between the several impression cylinders. Therefore, it is easier to keep the cylinders of the printing press 1 in registry with each other.

To further facilitate the maintenance of the impression cylinders in registry with each other, the impression cylinders are provided with a tab adjacent the image in the cylinder. The press 1 includes detectors for determining the position of the tab. Thus, the rotational position of each impression cylinder I1–I5, and hence the rotational position of the image on each of the impression cylinders I1–I5 is known. Thus, prior to printing, the controller 3 can bring the cylinders into registry with each other by rotating each of the cylinders to a 0° or start position. With the process print job being started with the cylinders in registry with each other, and with the controller 3 controlling the cylinders I1–I5 via the motors M2–M6, the controller is able to maintain the cylinders in registry with each other. Thus, the image printed at each station will be in registry with, or in alignment with, the image from the prior printing station. Thus, the image printed at the printing area 15 will be properly printed and free of blurred images.

After printing at print area 15, the web W passes through a lamination nip 17 on its way to a rewind roller 19. At the lamination nip 17, the web W can be laminated with a lamination web L. The lamination web L is maintained on a lamination unwind roller 19 and travels a path LP form the roller 19 to a lamination print station PS6 having an impression cylinder I6 and a print cylinder P6. As with stations PS1–PS5, the impression cylinder I6 is directly driven by a motor M7. The print cylinder P6 is then driven by the impression cylinder I6. The motor M7 is the driving force which pulls the lamination web L from the lamination unwind roller 19. As with the main roller 7, the lamination unwind roller 19 is not motor driven.

A tension transducer T2 is provided in the float area F2 between the lamination unwind roller 19 and the lamination print station P6 to maintain the lamination web L under a proper tension. The tension transducer T2 generates a signal indicative of the tension of the lamination web L in the float area F2 and transmits that signal to a tension controller TC2. The tension controller TC2 controls a pneumatic brake B2 in response to the signal from the tension transducer T2. If it is determined that the tension is too loose, the tension controller TC2 operates the brake B2 to clamp down on the roller 19 to increase the tension of the lamination web L. Conversely, if it is determined that the tension is too great, the tension controller TC2 operates the brake B2 to reduce its grip on the roller 19 to allow the roller 19 to rotate more freely on its axis to reduce the tension in the lamination web.

An electric eye E3, preferably an ultrasonic sensor like the electric eye El, is provided adjacent the lamination unwind roller 19 to determine the diameter of the web around the unwind roller 19. The eye E3 generates a signal indicative of the radius or diameter of the roller 19, and transmits this signal to the controller 3 which converts the information to determine the amount of substrate remaining on the roller. The controller 3 then uses this information to control the brake B2 and the motor M7.

From the lamination print station PS6, the lamination web L is pulled to the lamination nip 17 where the lamination web is applied to the main web W to laminate the main web W. At the print station PS6, an adhesive coating is applied to the lamination web L to adhere the lamination web L to the main or printed web W. The main web W is passed through a series of rollers such that its printed surface is covered by the lamination web L to produce a laminated web LW which is rolled about a rewind roller 21. The lamination nip is powered by a motor M8 to pull the main web W from the print area 15 and the lamination web L from the lamination print station PS6.

The main web W passes through a float area F3. A tension transducer T3 is provided in the float area F3 between the last print station PS5 of the main print area 15 and the lamination nip 17 to maintain the main web W under a proper tension. The tension transducer T3 generates a signal indicative of the tension of the web W in the float area F3 and transmits that signal to the controller 3. The controller 3 uses the information relating to the tension of the web W in the float area F3 to control the speed of the motor M8 which controls the speed of the nip 17. So that the web W is properly laminated, the controller also controls the speed of the motor M7 which controls the lamination print station PS6. As can be appreciated, a change in speed of the motor M7 will affect the tension in the lamination web L, and thus the lamination tension controller TC2 will also be affected, albeit indirectly, by signals from the tension transducer T3.

Lastly, the laminated web LW is rolled around a rewind roller 21. The rewind roller 21 is driven by a motor M9. Whereas the motors M1–M8 are preferably AC brushless synchronous motors, the motor M9 is preferable a DC motor. An electric eye E4, preferably an ultrasonic sensor, is positioned adjacent the rewind roller 21 to monitor the size (diameter) of the rewind roller. The eye E4 transmits a signal indicative of the size of the rewind roller 21 to the controller 3. The laminated web LW passes through a last float area F4. To maintain the proper tension of the laminated web LW in the float area F4, the web LW passes over a tension transducer T4, which generates a signal indicative of the tension of the web LW in the float area F4. The signal from the tension transducer T4 is received by the controller 3 and is used to control the speed of the motor M9 to control the speed of the rewind roller 21.

Figure 2:
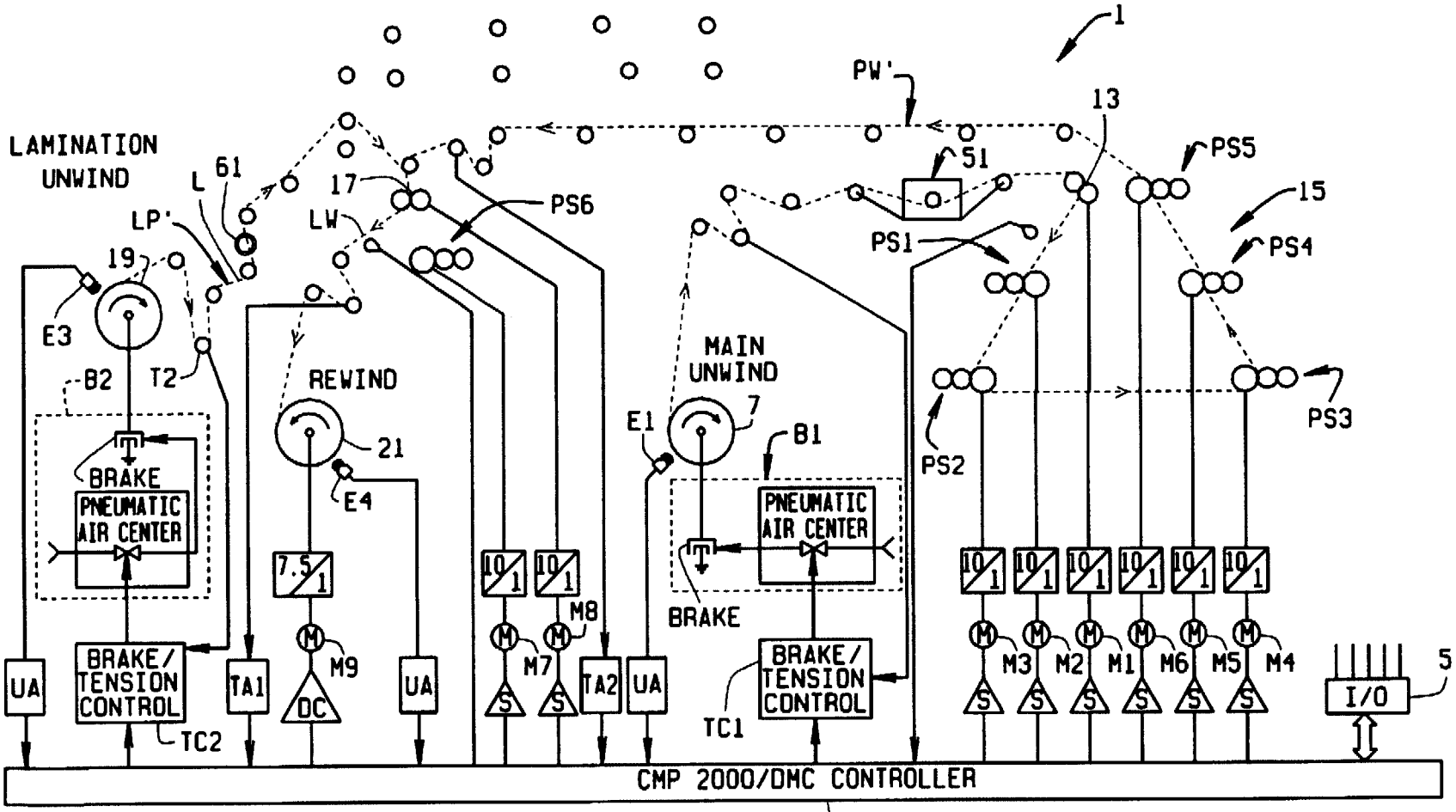
FIG. 2 is a schematic of the printing press configured for printing on a film substrate and then applying a film lamination to the substrate.

The paths PW and PL followed by the main web W and the lamination web L in FIG. 1 demonstrate the use of the press 1 for printing on paper and then laminating the paper with a film. Turning to FIG. 2, the press 1 is shown adapted for printing on a film and laminating film-to-film. The path of the web PW' through the press 1 from the unwind roller 7 through the print stations PS1–PS5, to the lamination nip, and the rewind roller 21 is substantially the same as the path PW of the web W as shown in FIG. 1. However, in this instance the web W passes through a web guide 51. The web guide 51 is provided to line up the web.

As can be appreciated, the capability of the controller to maintain the cylinders of the print stations PS1–PS5 in registry with each other enables the press 1 to print on a film substrate without any significant variation in which it prints on a paper substrate. The provision of the electric eye E2 facilitates this. As can be appreciated, the speed of the substrate from the main nip 13 will be different for a film substrate than for a paper substrate. Further, the speed of the film substrate may vary after the main nip 13 if the substrate stretches. The controller 3, however, through the eye E2, monitors the speed of the film and thus can change the speed of the cylinders at the print stations PS1–PS5 as necessary to maintain the cylinders in registry with each other. Further, because the controller 3 also monitors the rotational position of the impression cylinders as noted above, the controller can use this information to control the speeds of individual motors M2–M6 to ensure that the cylinders at the printing stations PS1–PS5 are maintained in registry with each other.

The path PL' of the lamination web L, however, is much different from the path PL shown in FIG. 1. The lamination web L travels from the lamination unwind roller 19, over the tension transducer T2, through a corona treater 61 and to the lamination nip 17 where the printed film is laminated with the lamination film. The corona treater is provided to treat the film. The laminated web LW then is carried to the rewind roller 21. As can be seen, the lamination web L does not pass through the lamination print station PS6. The lamination web L is brought to the printed web W so that the printed side of the web W is laminated.

Figure 3:
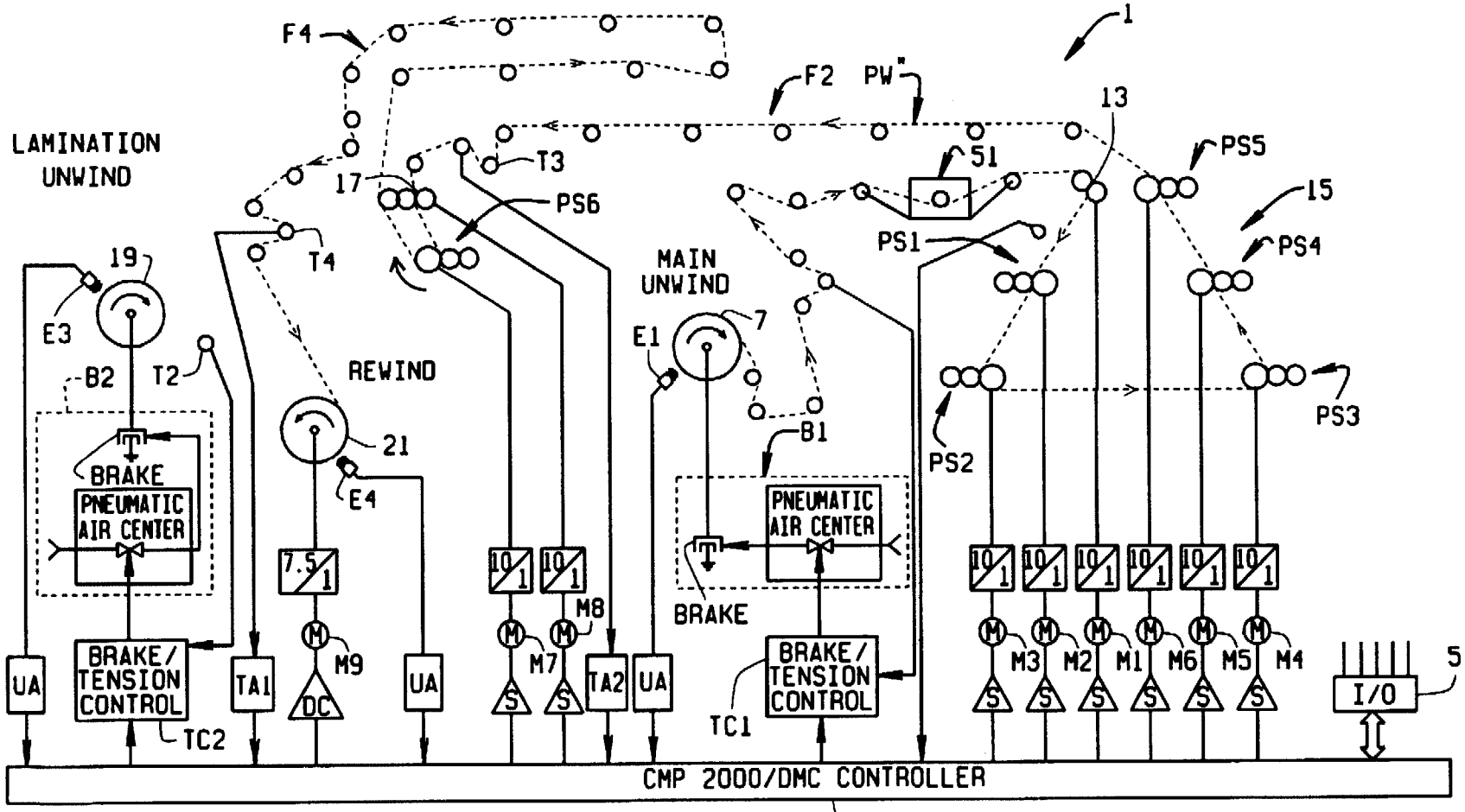
FIG. 3 is a schematic of the printing press configured to print on a substrate and to apply a cold seal or PVA on a side of the substrate opposite the printing.

Turning to FIG. 3, the printing press 1 is shown adapted to print on paper or film and to apply a cold seal or PVA coating to the printed substrate on the unprinted side of the substrate. In this adaptation of the press 1, no lamination web is used. The electric eye E3 adjacent the lamination unwind roller 19 generates its signal indicative of the size of the roller 13. The controller 3 interprets the signal from the eye E3 and determines that the lamination unwind roller 19 is empty and thus discards any signals it may receive from the tension transducer T2. The path PW" taken by the web W is again substantially the same as the path PW or PW' taken by the web W as shown in FIGS. 1 and 2. The web W is taken off the main unwind roller 7 by the main nip 13. The web passes about the tension transducer T1, through the web guide 51, through the main nip 13 and the printing stations PS1–PS5. From the last printing station PS5, the web travels through the float area F2, about the tension transducer T3 and to the second nip 17. As in FIGS. 1 and 2, the nip 17 is driven by the motor M8 and is controlled to maintain the tension of the web W between the main nip 13 and the second nip 17. The nip 17, as can be appreciated, effectively pulls the web through the printing stations PS1–PS5.

From the second nip 17, the web W is pulled to the printing station S6 where a cold seal of adhesive or a PVA seal is applied to the web W. The web W is brought to the printing station PS6, and passes through the printing station PS6, such that the cold seal or PVA coating is applied to the web on the side opposite of the printed side of the web (i.e., the cold seal or PVA coating is applied to the unprinted side of the web). From the printing station PS6, the coated web travels through a fourth float area F4 and over a plurality of rollers to the rewind roller 21. The float area F4 is sized to allow the cold seal or PVA coating to set or dry before the coated web is wrapped about the rewind roller 21.

As can be appreciated from the foregoing description, the printing press 1 can print on either paper or film substrates and can be adapted to laminate either of the substrates or to apply a seal to the substrate. The cylinders at the print stations are directly and independently driven by their respective motors and controlled by the controller 3. The feed back provided to the controller from the various sensors allows the controller to maintain the cylinders of the various print stations in register with each other. The fact that the cylinders are directly driven rather than gear driven (i.e. are gearless) facilitates in maintaining the cylinders in register with each other.

The adaptability of the printing press 1 enables the press to (1) print in five colors on paper or film; (2) pit in four colors on film and laminate film-to-film in line; (3) print in five colors on paper or film ad apply PVA adhesive or cold seal adhesives on the other side of the web in register; (4) print on already demetallized polyester in register and laminate in line; and/or (5) print on already printed roll stock additional colors on both sides or the web in register.

In view of the above, it will be seen that the several objects and advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense.

I claim:

1. A printing press capable of printing in a plurality of colors and of printing on a paper or film substrate, the printing press including:

a main unwind roller about which the substrate to be printed is wound;

a main nip through which the substrate passes, the nip being directly driven by a main nip motor;

a substrate printing area comprising a plurality of print stations, each said print station having an impression cylinder, a printing cylinder in rolling contact with the impression cylinder to be driven thereby, and a motor which directly drives the impression cylinder;

a rewind roller about which the printed substrate is wound;

a rewind motor which drives the rewind roller; and alignment means for maintaining the printing stations in registry with each other to substantially prevent the printing of blurred multi-colored images; the alignment means including a central processing unit;

a speed monitor for monitoring the speed of the substrate between the main nip and a first of the plurality of printing stations; said speed monitor generating a signal indicative of the speed of the substrate, said speed signal being received by the central processing unit; and means for monitoring the rotational position of the at least one of the cylinders of each printing station, said cylinder monitoring means generating a signal indicative of the rotational position of the cylinder of each printing station, said signal being received by said central processing unit;

said central processing unit individually controlling said main nip motor and each printing station motor to maintain said printing stations in alignment.

2. The printing press of claim 1 wherein the means for monitoring the rotational position of the printing station cylinders includes a tab on the cylinder at a known location and a sensor for sensing the rotational position of the tab, the sensor generating a signal indicative of the rotational position of the cylinder, and hence of the image to be printed at the print station, said central processing unit receiving said sensor signal and individually controlling the print station motors in response to the signal.

3. The printing press of claim 2 including a first float area between the main unwind roller and the main nip, the printing press including a controller for automatically maintaining the tension of the substrate in the first float area.

4. The printing press of claim 3 wherein the tension controller includes a tension transducer in contact with the substrate to measure the tension of the substrate, a brake in operative contact with the main unwind roller, and a brake controller, said brake controller receiving a signal from the tension transducer and controlling said brake in response to said tension transducer signal to maintain the tension at a desired level.

5. The printing press of claim 3 including a rewind nip between said printing area and said rewind roller, a motor for driving said rewind nip, and a second tension controller for maintaining the tension of the substrate in a second float area between the printing area and the rewind nips.

6. The printing press of claim 5 wherein said second tension controller includes a second tension transducer in contact with said web in said second float area, said central processing unit controlling the speed of said rewind nip roller in response to the signal from said tension transducer to maintain the tension of said web in said second float area.

7. The printing press of claim 5 including a third tension controller for maintaining the tension of the substrate in a third float area between the rewind nip and the rewind roller.

8. The printing press of claim 7 wherein said third tension controller includes a third tension transducer in contact with said substrate in said third float area to determine the tension of the web in said third float area, said third tension transducer generating a signal indicative of the tension of the substrate in the third float area; said central processing unit controlling the speed of said rewind motor to maintain the tension of said substrate in said third float area at a desired level.

9. The printing press of claim 7 including a coating station between said second and third float areas, said coating area applying one or both of a cold seal and a PVA coating to the substrate.

10. The printing press of claim 9 including a web guide in the first float area.

11. The printing press of claim 7 including a lamination unwind roller about which a lamination web can be wound, the lamination web passing through a fourth float area between said lamination unwind roller and said rewind nip, said lamination web being joined to said substrate at said rewind nip.

12. The printing press of claim 11 including a fourth tension controller for maintaining the tension of the lamination web at a desired level in said fourth float area.

13. The printing press of claim 12 wherein the fourth tension controller includes a fourth tension transducer in contact with the lamination web to measure the tension of the lamination web in the fourth float area, a second brake in operative contact with the lamination unwind roller, and a brake controller, said brake controller receiving a signal from the fourth tension transducer and controlling said second brake in response to said fourth tension transducer signal to maintain the tension of the lamination web at a desired level in the fourth float area.

14. The printing press of claim 12 wherein the substrate is a film, the printing press including a corona treater in the fourth float area through which the lamination web travel.

15. The printing press of claim 12 wherein the substrate is paper, the printing press including a lamination print station between said lamination unwind roller and the rewind nip, said lamination print station applying an adhesive to said lamination web to adhere the lamination to the paper substrate.

16. A printing press capable of printing in a plurality of colors and of printing on a paper or film substrate, the printing press including:

a central processing unit;

a main unwind roller about which the substrate to be printed is wound;

a main nip through which the substrate passes, the nip being directly driven by a main nip motor;

a substrate printing area comprising a plurality of print stations, each said print station having an impression cylinder, a printing cylinder in rolling contact with the impression cylinder to be driven thereby, and a motor which directly drives one of the impression cylinder and the printing cylinder;

a speed monitor for monitoring the speed of the substrate between the main nip and a first of the plurality of printing stations; said speed monitor generating a signal indicative of the speed of the substrate, said speed signal being received by the central processing unit, said central processing unit individually controlling the print station motors to maintain the print stations in registry with each other;

a sensor for monitoring the rotational position of the at least one of the cylinders of each printing station, said cylinder monitoring means generating a signal indicative of the rotational position of the cylinder of each printing station, said signal being received by said central processing unit;

a rewind roller about which the printed substrate is wound;

a rewind motor which drives the rewind roller;

a lamination nip positioned between the rewind roller and the main print area;

a motor which drives the lamination nip;

a lamination unwind roller capable of holding a lamination web, said lamination nip driving said lamination roller by pulling on the lamination web;

a first tension controller for maintaining the tension of the substrate in a first float area between the unwind roller and the main nips at a desired level;

a second tension controller for maintaining the tension of the substrate in a second float area between the main nips and the lamination nip a desired level;

a station for treating the lamination web to adhere the lamination web to the substrate; and first and second sensors for monitoring the size of the unwind and rewind rollers, respectively, said sensors generating a signal indicative of the size of their respective rollers, said central processing unit controlling the main nips motor, the print station motors and the rewind motor in response to the signal received from the first and second sensors.

* * * * *